US006163227A

United States Patent [19]

Saitoh et al.

[11] Patent Number: 6,163,227

[45] Date of Patent: Dec. 19, 2000

[54] NON RADIATIVE DIELECTRIC WAVEGUIDE HAVING A PORTION FOR LINE CONVERSION BETWEEN DIFFERENT TYPES OF NON RADIATIVE DIELECTRIC WAVEGUIDES

[75] Inventors: Atsushi Saitoh, Muko; Toru Tanizaki, Kyoto; Hiroshi Nishida, Kawanishi; Ikuo Takakuwa, Suita; Yoshinori Taguchi, Nagaokakyo, all of Japan

[73] Assignee: Murata Manufacturing Co., Ltd., Japan

[21] Appl. No.: 09/216,575

[22] Filed: Dec. 18, 1998

[30] Foreign Application Priority Data

Dec. 26, 1997 [JP] Japan ..... 9-358789

[51] Int. Cl.[7] ..... H01P 3/16

[52] U.S. Cl. ..... 331/117 D; 333/248; 333/249; 333/239; 333/34

[58] Field of Search ..... 333/239, 248, 333/249, 34; 331/117 D, 116 R, 107 DP

[56] References Cited

U.S. PATENT DOCUMENTS 5,982,255 11/1999 Tanizaki et al. ..... 333/239

FOREIGN PATENT DOCUMENTS 0767507 4/1997 European Pat. Off. .

OTHER PUBLICATIONS

Tsukasa Yoneyama: "Millimeter–Wave Integrated Circuits Using Nonradiative Dielectric Waveguide" Electronics & Communications in Japan, Part II—Electronics, vol. 74, No. 2, Feb. 1, 1991, pp. 20–28, p. 20, right–hand column, line 9, line 22, p. 21, right–hand column, line 14–line 27, figures 1, 8, 13.

Xiao L –L et al.: "Analysis of Groove NRD Waveguide Bend Using the Coupled–Mode Theory" International Journal of Infrared and Millimeter Waves, vol. 13, No. 7, Jul. 1992, pp. 971–980, p. 971, line 10 –line 24.

European Search Report dated Apr. 8, 1999.

*Primary Examiner*—Benny Lee
*Assistant Examiner*—Kimberly E Glenn
*Attorney, Agent, or Firm*—Ostrolenk, Faber, Gerb & Soffen, LLP

[57] ABSTRACT

In a millimeter wave module or the like having both a normal NRD guide and a hyper NRD guide, a conversion portion structure for non, radiative dielectric waveguides of different types has excellent conversion characteristics at the connection between the two types of NRD guides. In a first conversion portion, the width of a dielectric strip is changed from the width of a dielectric strip in the hyper NRD guide portion to the width of a dielectric strip in the normal NRD guide portion, grooves of approximately the same depth as grooves in the hyper NRD guide are provided extending as far as the second conversion portion, and in a third conversion portion, the width of these grooves widens perpendicular to the propagation direction of electromagnetic waves and parallel to the face of conductive plates. According to this structure, guide conversion can be achieved with low radiation in a predetermined frequency band.

9 Claims, 14 Drawing Sheets

NON RADIATIVE DIELECTRIC WAVEGUIDE HAVING A PORTION FOR LINE CONVERSION BETWEEN DIFFERENT TYPES OF NON RADIATIVE DIELECTRIC WAVEGUIDES

BACKGROUND OF THE INVENTION

1. Field of the Invention

The present invention relates to a non radiative dielectric waveguide ("NRD"), particularly to a non radiative dielectric waveguide having a portion for line conversion between different types of non radiative dielectric waveguides for use in millimeter-wave band or microwave band communication apparatuses for example.

2. Description of the Related Art

As shown in FIG. 2, a dielectric guide, comprising a dielectric strip 3 provided between two roughly parallel conductive plates 1 and 2, is used as a transmission line in the millimeter wave band and microwave band. In particular, a non radiative dielectric waveguide has been developed, wherein the space a2 between the conductive plates 1 and 2 is less than half of the propagation wavelength of the electromagnetic waves, so that the wave propagates only through the dielectric strip. This type of NRD guide is called a normal NRD guide.

A millimeter wave module using the NRD guide is formed by integrating non radiative dielectric waveguide components (hereinafter "components") such as an oscillator, a mixer and a coupler (directional coupler), and at first, a normal NRD guide was used as the NRD guide in these components.

On the other hand, the above normal NRD guide had a disadvantage that mode conversion between LSM01 mode and LSE01 moce at bends resulted in transmission loss, making it impossible to design a bend with a given radius of curvature, and for this reason, radius of curvature could not be made smaller in order to avoid transmission loss caused by the mode conversion, with the result that the overall module size could not be made small-scale. Therefore, as shown in FIG. 1, there was developed an NRD guide for transmitting in a single LSM01 mode (hereinafter "hyper NRD guide"), wherein grooves are provided in opposing faces of the conductive plates 1 and 2 and the dielectric strip 3 is provided in the grooves, as disclosed in a laid-open Japanese Patent Application No. 09-102706.

According to the hyper NRD guide, it is possible to design a bend having a given radius of curvature and little transmission loss, enabling the overall module to be made small-scale. Nevertheless, apart fromn the fact of transmission loss caused at bends by mode conversion, the normal NRD guide generally has less transmission loss.

Furthermore, when one millimeter wave module comprises a combination of the above components, positional deviation, in the direction of electromagnetic wave propagation or perpendicular to the direction of electromagnetic wave propagation, inevitably occurs at connecting faces of the conductive plates and the dielectric strip in accordance with the dimensional precision and assembly precision of the components, and moreover, the extent cf such deviation varies. The normal NRD guide has better reflecting characteristics and passing characteristics, depending on the extent of deviation, at connections between components.

Furthermore, in an NRD guide switch, wherein two NRD guides can be selectively connected, reflecting and passing characteristics during switch-on (connected state) are better when normal NRD guides are used as the two NRD guides.

Furthermore, in a directional coupler, for instance, when two normal NRD guides are provided with a predetermined space between them, field energy distribution is wider than when hyper NRD guides are used, and consequently better characteristics can be obtained without requiring high dimensional precision.

Therefore, when NRD guides are used in portions where normal NRD guide characteristics can be best utilized, and hyper NRD guides are used in portions where hyper NRD guide characteristics can be best utilized, a millimeter wave integrated circuit which is small-scale overall and has excellent characteristics can be realized.

SUMMARY OF THE INVENTION

Accordingly, it is an object of the present invention to provide a conversion portion structure for non radiative dielectric waveguides of different types having excellent guide characteristics at the interface and connection between both NRD guides, used when forming a non radiative dielectric waveguide component, comprising a combination of a normal NRD guide and a hyper NRD guide, and an integrated circuit comprising a combination of a plurality of the components.

It is another object of the present invention to provide a non radiative dielectric waveguide component, comprising a guide conversion portion for a normal NRD guide and a hyper NRD guide, and an integrated circuit comprising a combination of a plurality of the components.

A first aspect of the present invention provides a conversion portion structure for non radiative dielectric waveguides of different types for connecting a first non radiative dielectric waveguide, comprising a dielectric strip provided between two opposing conductive plates, to a second non radiative dielectric waveguide, comprising two conductive plates, having grooves provided therein at opposing positions, and a dielectric strip inserted between the opposing grooves, comprising: a first conversion portion, wherein a width of a dielectric strip is changed from a width of the dielectric strip of the second non radiative dielectric waveguide to a width of the dielectric strip of the first non radiative dielectric waveguide; a second conversion portion, having groove of substantially the same depth as the grooves and a dielectric strip of substantially the same width as the dielectric strip of the first non radiative dielectric waveguide; and a third conversion portion, comprising a portion wherein the grooves of the second conversion portion widen in a direction roughly perpendicular to the direction of electromagnetic wave propagation and parallel to faces of the conductive plates, and a dielectric strip of the first non radiative dielectric waveguide.

According to such a constitution, the first conversion portion converts the width of a dielectric strip of the first non radiative dielectric waveguide to the width of a dielectric strip of the second non radiative dielectric waveguide, and the second conversion portion performs conversion relating to the provision of grooves in the first non radiative dielectric waveguide and the second non radiative dielectric waveguide. Furthermore, the third conversion portion performs conversion between a first non radiative dielectric waveguide and a guide portion having intermediate grooves.

Furthermore, in the above constitution, by determining the length of the second conversion portion such that waves radiated in the first conversion portion and waves radiated in the third conversion portion merge with reverse phases, a low-radiation structure for converting non radiative dielectric waveguides of different types can be obtained.

The abovementioned second conversion portion and third conversion portion have grooves of width widening from the second non radiative dielectric waveguide to the first non radiative dielectric waveguide, and therefore they may be provided continuously.

In a second aspect of the conversion portion structure for non radiative dielectric waveguides of different types, in the first conversion portion, the width of the grooves of the second non radiative dielectric waveguide widens to a horn-shape, and the width of a dielectric strip widens along the grooves; and, in the second conversion portion, the grooves of the second conversion portion follow the grooves widened to the horn-shape and widen from the first conversion portion toward the dielectric strip of the first non radiative dielectric waveguide. According to this constitution, the width of the dielectric strips in the first non radiative dielectric waveguide and the second non radiative dielectric waveguide gradually changes, reducing radiation in that portion to a low level. Furthermore, in the second conversion portion, the width of the grooves gradually changes from the portion of the first non radiative dielectric waveguide, wherein no grooves are provided, to the portion of the second non radiative dielectric waveguide, wherein grooves are provided, and therefore radiation in this portion is also reduced.

In a third aspect, a non radiative dielectric waveguide part comprises a switch, wherein at least two first non radiative dielectric waveguides oppose each other selectively, either one or both of said first non radiative dielectric waveguides comprising a conversion portion for non radiative dielectric waveguides of different types according to the first and second aspects. Consequently, it is possible to obtain excellent propagation characteristics in a switch connected state at a connection between non radiative dielectric waveguides, and in addition, since a second non radiative dielectric waveguide is used as the guide leading to the switch portion, this is effective when a non radiative dielectric waveguide switch is provided to a part implementing the second non radiative dielectric waveguide.

In a fourth aspect of the non radiative dielectric waveguide part, one of the two first non radiative dielectric waveguides, opposing each other selectively at the connection, rotates so as to move relatively in a direction parallel to faces of conductive plates of a first non radiative dielectric waveguide and perpendicular to the direction of electromagnetic wave propagation. According to this constitution, connection can be performed during relative motion with low radiation and low transmission loss. Therefore, it is effective at a switch leading to a second non radiative dielectric waveguide (hyper NRD guide), and when continuously switching during the above rotation.

In a fifth aspect, a non radiative dielectric waveguide part comprises a coupler, comprising two first non radiative dielectric waveguides provided with a predetermined interval in between, conversion portions for non radiative dielectric waveguides of different types according to the first and second aspects being provided at ends of these two first non radiative dielectric waveguides. According to this constitution, the conversion portion can be made small-scale without increasing the dimensional precision required of the interval between dielectric strips of first non radiative dielectric waveguides, and therefore it is possible to obtain a directional coupler which is small-scale overall and has stable characteristics.

In a sixth aspect of the non radiative dielectric waveguide part, a dielectric resonator and an oscillator are coupled to a first non radiative dielectric waveguide, the first non radiative dielectric waveguide comprising a conversion portion for non radiative dielectric waveguides of different types. This forms an oscillator, and a dielectric resonator can be strongly coupled to a non radiative dielectric waveguide, and moreover, a circuit leading to the oscillator comprises a second non radiative dielectric waveguide, and therefore, the part comprising the oscillator can be made small-scale overall.

In a seventh aspect, a part of a non radiative dielectric waveguide integrated circuit, being a part of an integrated circuit using the first and second non radiative dielectric waveguides, comprises a first non radiative dielectric waveguide, provided at a connection with another part of the integrated circuit which is adjacent thereto, the first non radiative dielectric waveguide comprising a conversion portion for non radiative dielectric waveguides of different types according to the first and second aspects. According to this constitution, it is possible to eliminate problems of deterioration and variation of characteristics, caused by position deviation at a connection between the integrated circuit parts, and there is no deterioration of characteristics caused by guide conversion, and consequently a non radiative dielectric waveguide integrated circuit with high overall characteristics can easily be obtained.

In an eighth aspect of a part of a non radiative dielectric waveguide integrated circuit, there is a connection at which a dielectric strip of the first non radiative dielectric waveguide is connected to another dielectric strip at a plurality of faces, separated from each other by a distance of an odd multiple of a quarter of the guide wavelength in the direction of electromagnetic wave propagation. According to this constitution, radiation at the connections is cancelled, whereby circuits, can be connected with low radiation.

In a ninth aspect, a non radiative dielectric waveguide integrated circuit comprises a combination of parts for non radiative dielectric waveguides according to any of the third~eighth aspects. Therefore, it is possible to achieve an integrated circuit which makes good use of characteristics of first and second non radiative dielectric waveguides, and suffers no deterioration of characteristics at guide conversion portions.

DESCRIPTION OF THE PREFERRED EMBODIMENTS

There will be detailed below a first preferred embodiment of the conversion portion for non radiative dielectric waveguides of different types of the present invention, with reference to FIG. 1 to FIG. 4.

Figure 1:
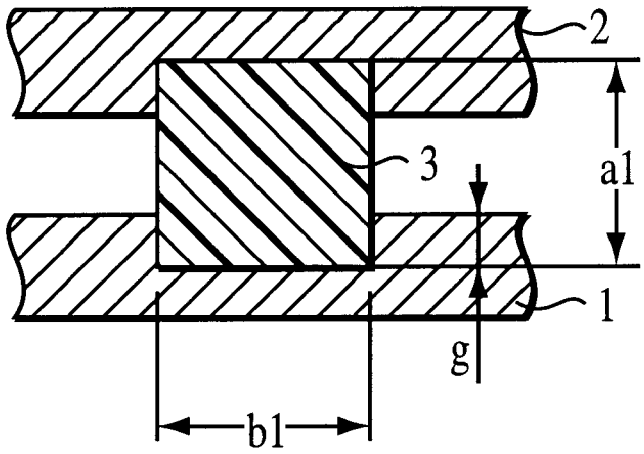
FIG. 1 PRIOR ART
FIG. 1 is a diagram showing a cross-sectional structure of a conventional hyper NRD guide.
Figure 2:
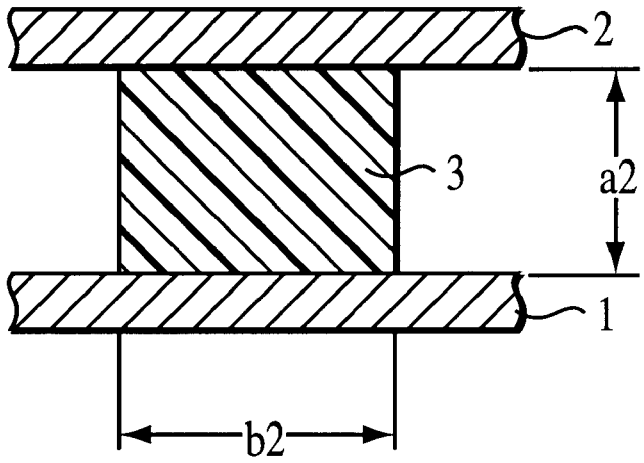
FIG. 2 PRIOR ART
FIG. 2 is a diagram showing a cross-sectional structure of a conventional normal NRD guide.

As already explained, FIG. 1 is a cross-sectional view of a hyper NRD guide portion, and FIG. 2 is a cross-sectional view of a normal NRD guide portion. In each NRD guide, a dielectric strip 3 is provided between upper and lower conductive plates 1 and 2. In the normal NRD guide of FIG. 2, the height a2 of the dielectric strip 3 is equal to the space between the conductive plates 1 and 2, but in the hyper NRD guide of FIG. 1, grooves of depth 9 are provided in the conductive plates 1 and 2, so that the space between the conductive plates 1 and 2 in regions where the dielectric strip 3 is not present is shorter than the height a1 of the dielectric strip 3, the region where the dielectric strip 3 is present functioning as a propagation region for propagating in a single LSM01 mode.

Figure 3A:
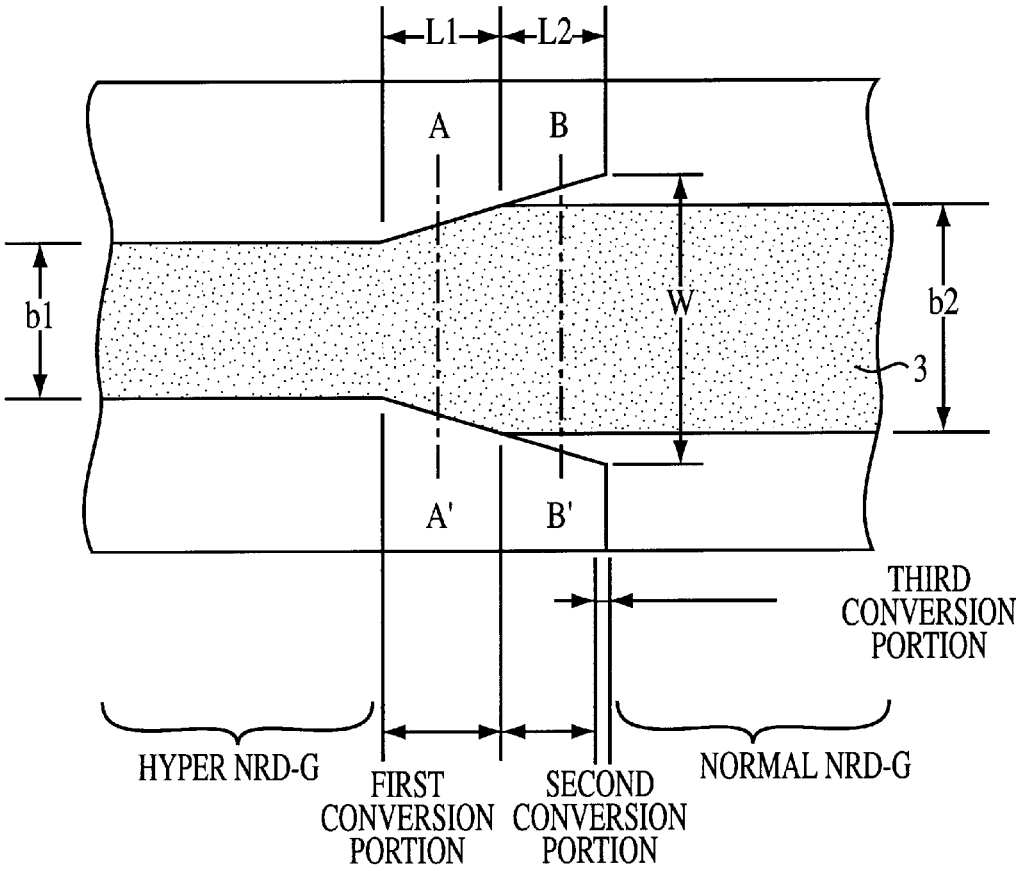
FIGS. 3A to 3C are diagrams showing a structure of a conversion portion for non radiative dielectric waveguides of different types according to a first embodiment of the invention.
Figure 3B:
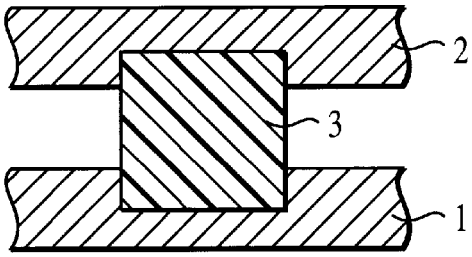
Figure 3C:
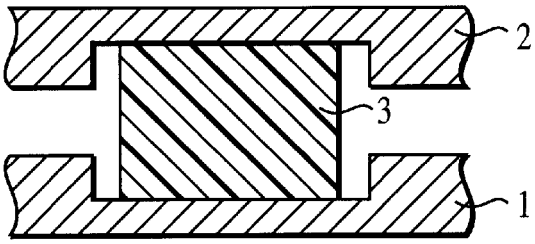

FIGS. 3A to 3C show a structure of a guide conversion portion for a normal NRD guide and a hyper NRD guide, FIG. 3A being a plan view when the upper conductive plate is removed, FIG. 3B, a cross-sectional view taken along the line A-A' of FIG. 3A, and FIG. 3C, a cross-sectional view taken along the line B-B' of FIG. 3A. As shown in the figures, in the mid-portion of the hyper NRD guide and the normal NRD guide, the first conversion portion changes over distance L1 from width b1, at the hyper NRD guide portion of the dielectric strip 3, to width b2, at the normal NRD guide portion. As the width of the dielectric strip 3 is tapered in this manner, the width of the grooves provided in the upper and lower conductive plates 1 and 2 also changes over distance L1 from b1 to b2. The second conversion portion has grooves of the same depth as the grooves in the hyper NRD guide portion, the width of these grooves leading from the first conversion portion over distance L2 and widening to a taper (or a horn), and eventually widening to W in a third conversion portion. Furthermore, in this second conversion portion, the dielectric strip 3 has the same width b2 as the dielectric strip in the normal NRD guide portion. In the third conversion portion, the width of grooves in the upper and lower conductive slates 1 and 2 widens in a direction roughly perpendicular to the propagation direction of electromagnetic waves and parallel to the faces of the conductive plates 1 and 2.

In this constitution, by setting the length L2 of the second conversion portion so that waves radiated in the first conversion portion have reverse phase to waves radiated in the third conversion portion, it is possible to obtain a conversion portion structure for non radiative dielectric waveguides of different types having low-radiation in a predetermined frequency band. Furthermore, the length L1 of the first conversion portion is set so that the amount of radiation in the first conversion portion is approximately the same as the amount of radiation in the third conversion portion.

Figure 4:
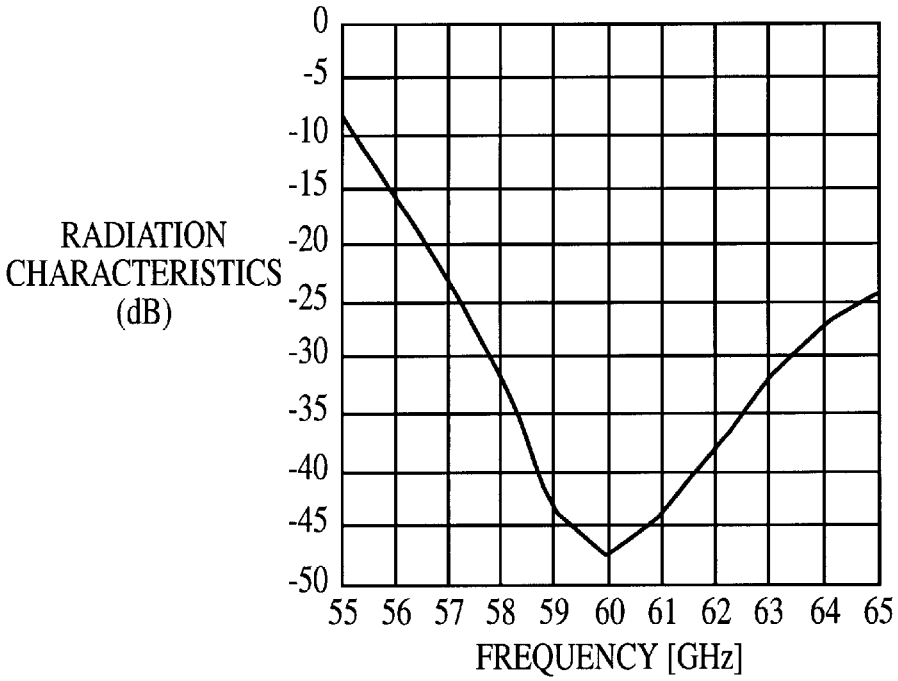
FIG. 4 shows reflection characteristics of the conversion portion of the waveguide of FIGS. 3A to 3C.

FIG. 4 shows radiation characteristics determined by three-dimensional finite-element method when the parts depicted in FIG. 1 to FIG. 3C have the following dimensions.

Dimensions of hyper NRD guide: a1=2.2 mm, b1=1.8 mm, g=0.5 mm

Dimensions of normal NRD guide: a2=2.2 mm, b2=3.0 mm

Dimensions of conversion portion L1=3.0 mm, L2=2.5 mm, W=4.0 mm

Dielectric strip 3 has dielectric constant $\in r=2.04$

Figure 5:
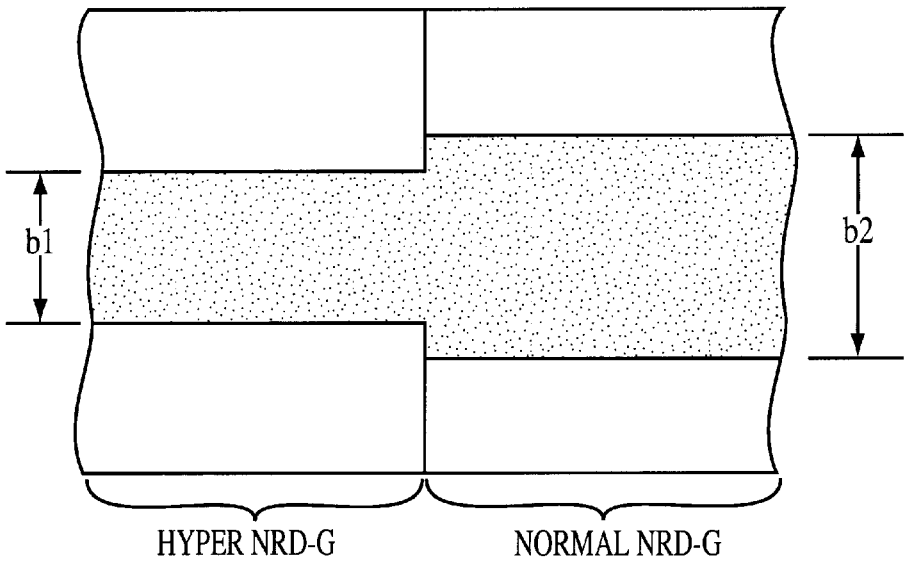
FIG. 5 is a diagram showing a structure of conversion portions for a hyper NRD guide and a normal NRD guide as a comparative example.
Figure 6:
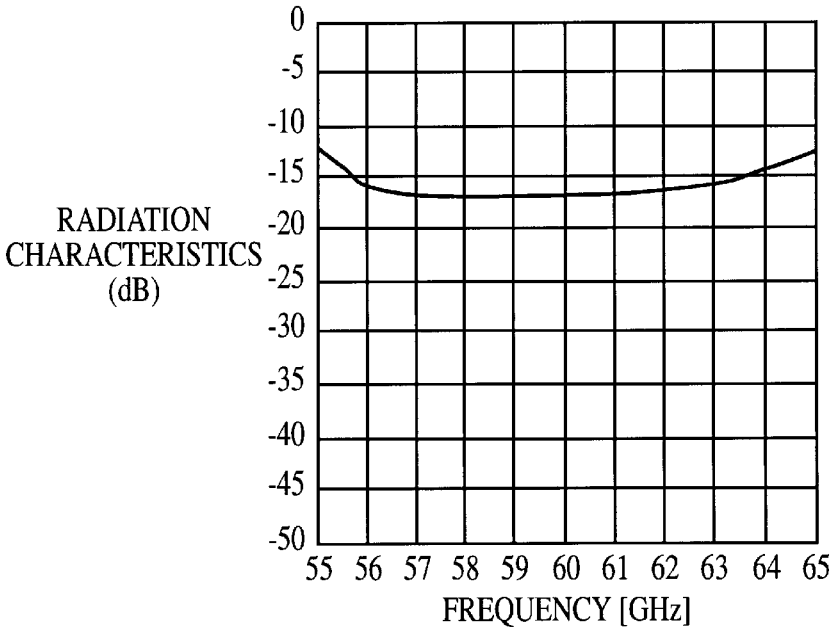
FIG. 6 shows reflection characteristics of the conversion portion of FIG. 5.

By way of comparison, FIG. 5 and FIG. 6 show structure and radiation characteristics when a hyper NRD guide converts directly to a normal NRD guide. Dimensions of each part of the hyper NRD guide and the normal NRD guide are the same as those shown above. As shown clearly in FIG. 6, when the hyper NRD guide is converted directly to the normal NRD guide, there is considerable radiation across a wide band. In contrast, in the first embodiment, it was possible to achieve low radiation in a predetermined frequency band.

Next, a structure of a conversion portion for norn radiative dielectric waveguides of different types according to a second embodiment will be explained based on FIG. 7 and FIG. 8.

Figure 7:
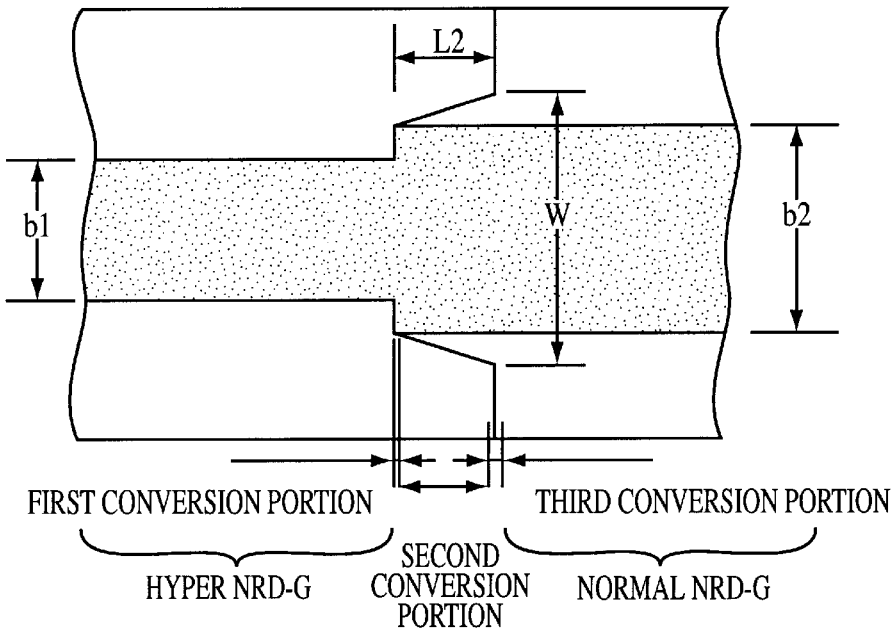
FIG. 7 is a diagram showing a structure of a guide conversion portion according to a second embodiment.
Figure 8:
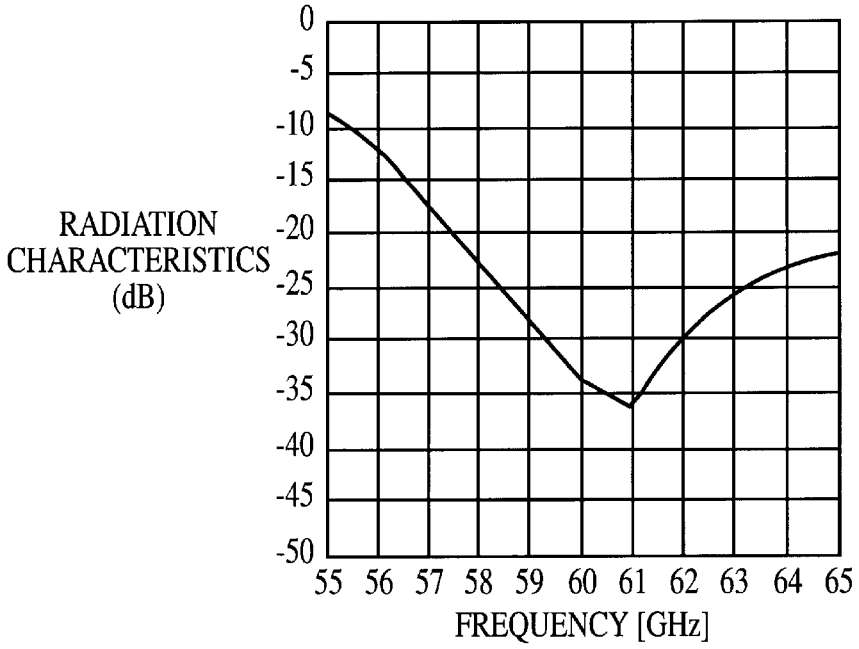
FIG. 8 shows reflection characteristics of the guide conversion portion of FIG. 7.

In the first embodiment, the first conversion portion had a predetermined length L1, but, as shown in FIG. 7, the length of the first conversion portion may alternatively be 0. FIG. 8 shows radiation characteristics in this case as determined by three-dimensional finite-element method. With the exception of L1=0, all the parts have the same dimensions as the first embodiment.

It can be seen that radiation characteristics can be kept low within a predetermined frequency band, even when the first conversion portion has no width along the direction of electromagnetic wave propagation. That is, by setting the length L2 of the second conversion portion so that waves radiated in the first conversion portion have reverse phase to waves radiated in the third conversion portion, it is possible to obtain a conversion portion structure for non radiative dielectric waveguides of different types having low radiation in a predetermined frequency band.

In the second embodiment shown in FIG. 7, the width of the grooves of the second conversion portion changed to a taper, but the width of these grooves need not be changed, and may be the same as the width of the dielectric strip in the normal NRD guide portion along the whole length of the second conversion portion.

Figure 9:
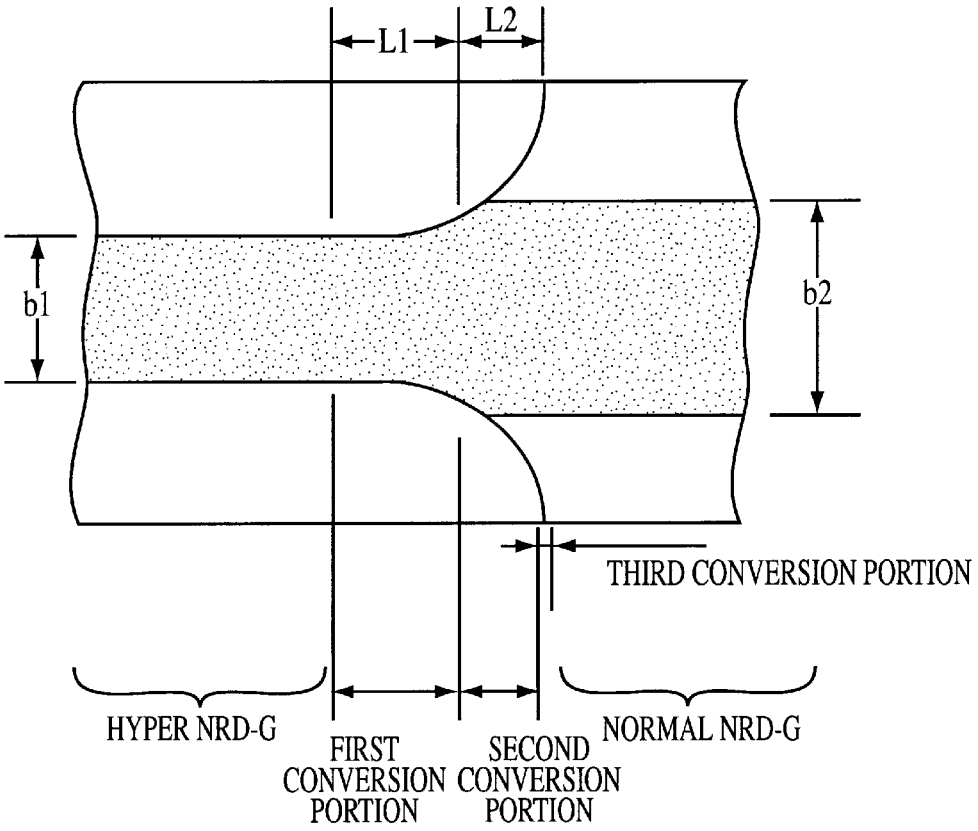
FIG. 9 is a diagram showing a structure of a guide conversion portion according to a third embodiment.

Then, FIG. 9 shows a structure of a conversion portion for non radiative dielectric waveguides of different types according to a third embodiment. In the first and second embodiments, the width of the grooves in the first~third conversion portions changed linearly, but, when providing grooves in the conductive plates 1 and 2 in this manner, there are cases where the angle of the corners cannot be made acute, for instance, when cutting is performed using an end mill, resulting in round corners as shown in FIG. 9; and furthermore, there are also cases where the corners of the dielectric strip become round in correspondence with the radius of the end mill, for instance, when the dielectric strip is cut out from PTFE plate material using an end mill; and in such cases, same effects can be obtained as were shown in the first and second embodiments.

In the first~third embodiments, a simple dielectric strip 3 was provided between two conductive plates, but alternatively, a dielectric substrate may be provided within one or both of the hyper NRD and normal NRD guides, parallel to the conductive plates. That is, the same effects can be obtained when a dielectric substrate is sandwiched between two conductive plates, with upper and lower dielectric strips provided in between, and a predetermined circuit is provided on the dielectric substrate.

Moreover, the first~third embodiments depicted an example in which no grooves were provided in the two conductive plates of the normal NRD guide, but it is acceptable to provide comparatively shallow grooves so as to secure the dielectric strip.

Next, a constitution of a millimeter wave radar module according to a fourth embodiment of the present invention will be explained referring to FIG. 10~FIG. 17.

Figure 10:
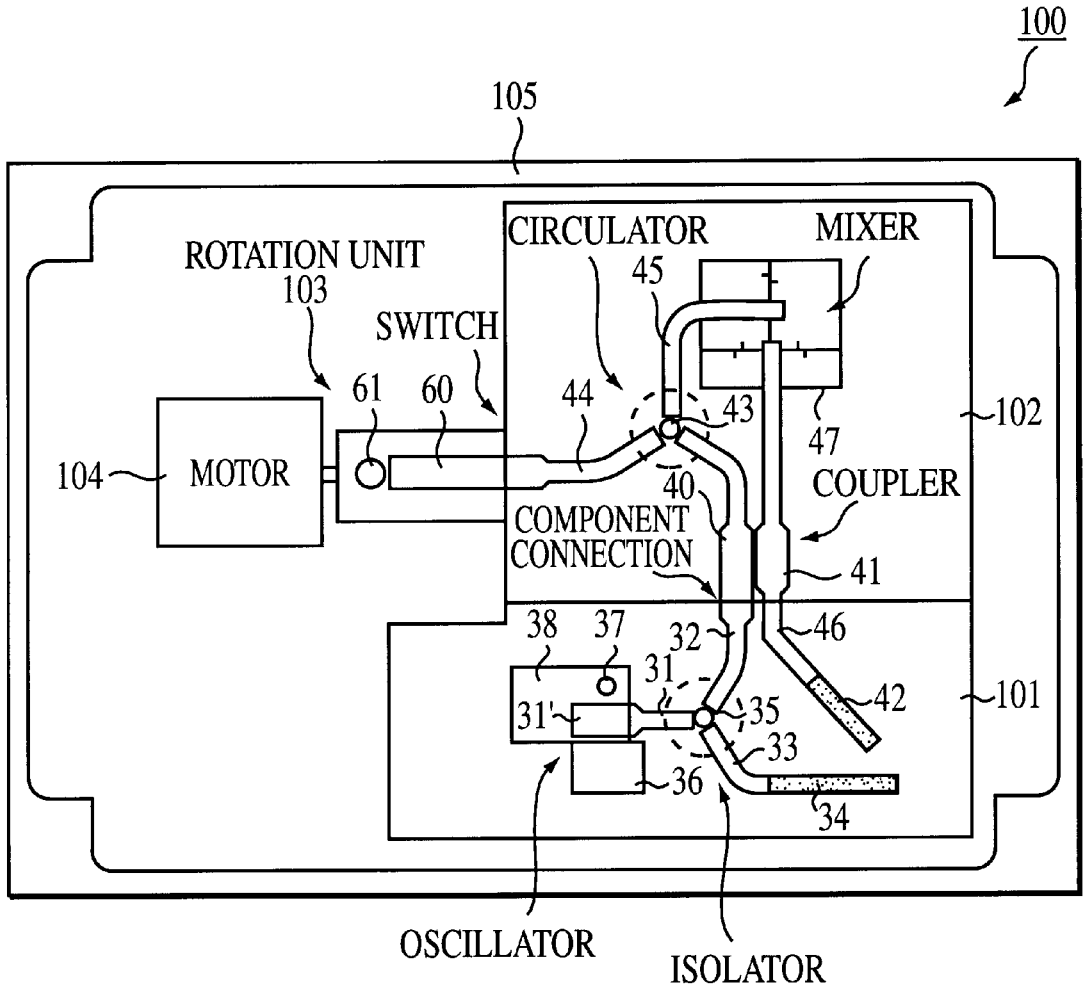
FIG. 10 is a diagram showing a constitution of a millimeter wave radar module.

FIG. 10 shows a state when the upper face dielectric lens portion of the millimeter wave radar module (the face which transmits and receives millimeter waves) is removed, and the upper conductive plate is also removed. The millimeter wave radar module comprises components 101 and 102, a rotation unit 103, a motor 104, a case 105 for containing these, a dielectric lens (not shown in the diagram) and related elements. The component 101 comprises an oscillator, an isolator and a terminator. The component 102 comprises a coupler, a circulator and a mixer.

Figure 11:
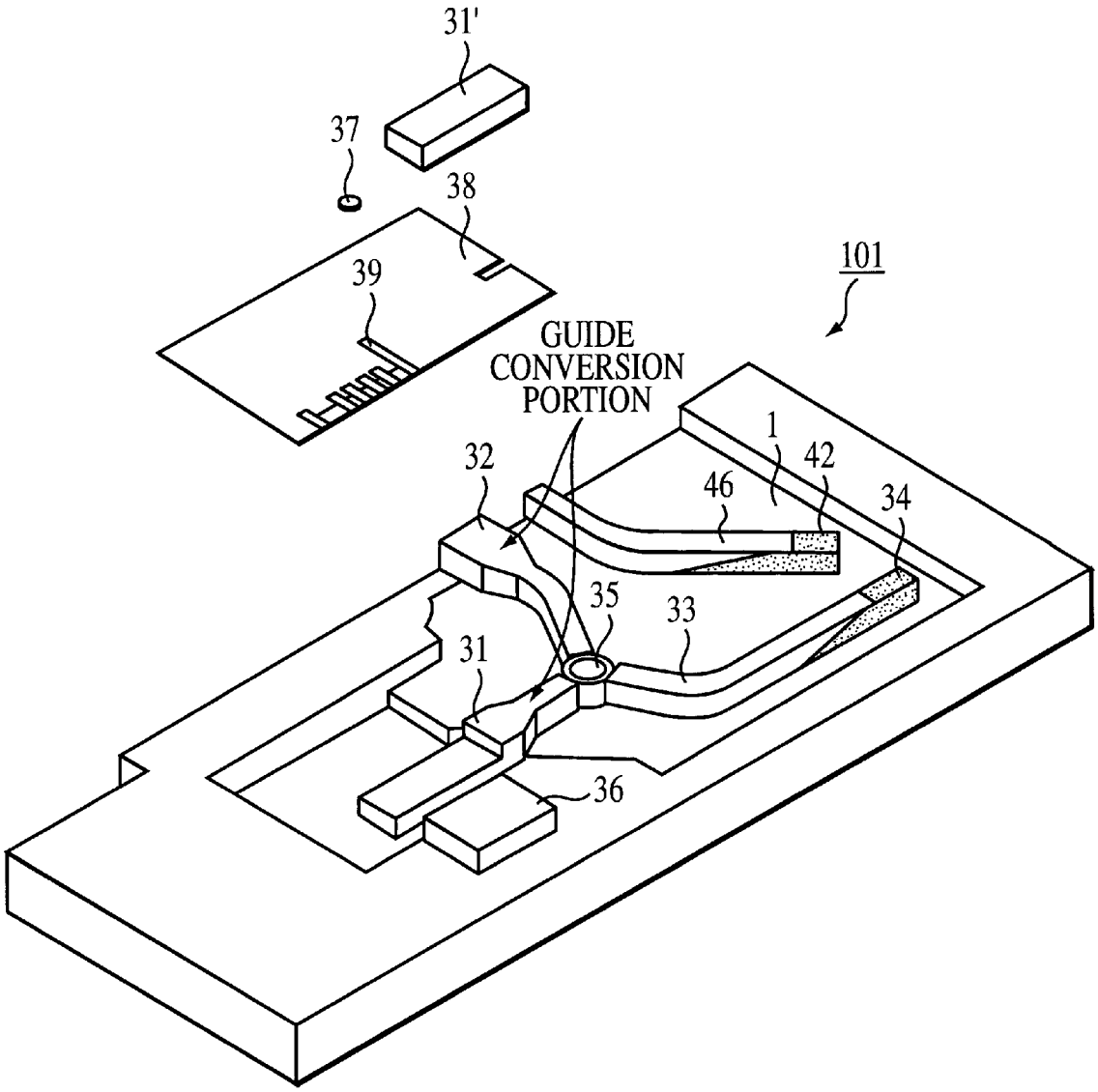
FIG. 11 is an exploded perspective view of a component comprising an oscillatorand an isolator.

FIG. 11 is an exploded perspective view illustrating the constitution of the component 101. In FIG. 11, dielectric strips 31, 32, 33 and 46 are provided between the lower conductive plate 1 and the upper conductive plate, which is not shown in the diagram. Various types of conductive patterns, such as an excitation probe 39, are provided on the surface of a dielectric substrate 38. This dielectric substrate 38 is sandwiched between dielectric strips 31 and 31'. Furthermore, a dielectric resonator 37 is coupled at a predetermined point of the dielectric strips 31 and 31'. One electrode of a Gunn diode block 36 connects to the excitation probe 39 on the dielectric substrate 38. Also provided is a ferrite resonator 35, which together with three dielectric strips and a magnet (not shown in the diagram) forms a circulator. Furthermore, a terminator 34 is provided at the end of the dielectric strip 33, thereby forming an isolator. When using this type of dielectric resonator to form an oscillator, by using a normal NRD guide as the NRD guide coupled to the dielectric resonator 37, a strong coupling can be obtained between the two. The dielectric strip 46 links to one of the dielectric strips forming the coupler of the component 102, and a terminator 42 is provided at the end of this dielectric strip 46.

Figure 21A:
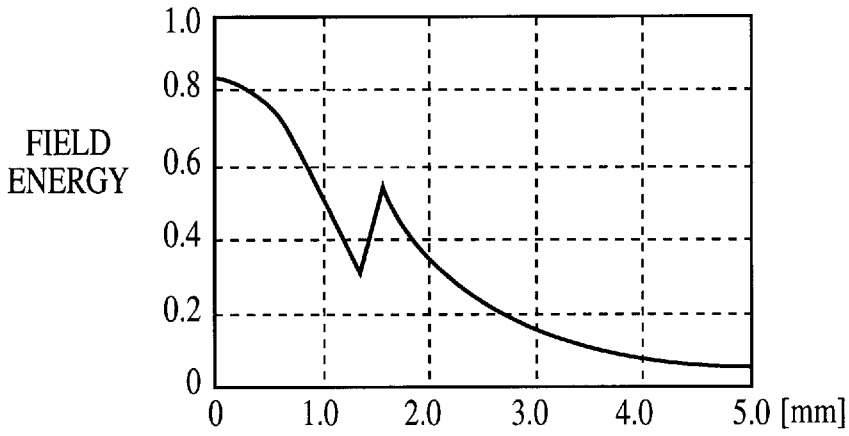
FIGS. 21A, 21B, 21C and 21D are diagrams showing field energy distribution in a normal NRD guide and a hyper NRD guide.
Figure 21B:
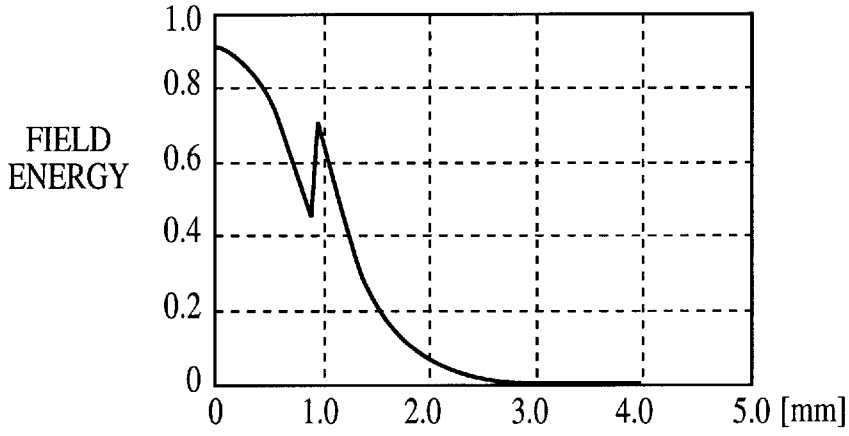
Figure 21C:
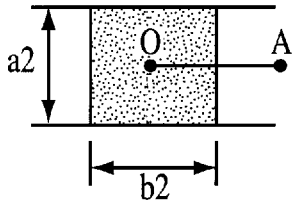
Figure 21D:
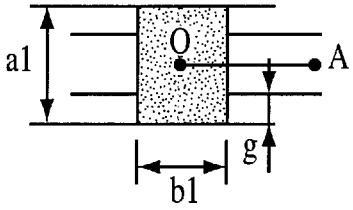

Here, FIGS. 21A and 21B show field energy distribution spreading from the center O of a dielectric strip horizontally to a point A, through the cross-section of a normal NRD guide (FIG. 21C) and a hyper NRD guide (FIG. 21D). A comparison of the two clearly reveals that, when the dielectric strips are provided at an equal distance, coupling in the normal NRD guide is stronger than in the hyper NRD guide, coupling strength changing smoothly as the distance changes, and therefore there is less need for dimensional precision in the relative positioning of the dielectric resonator 37 and the dielectric strips 31 and 31' shown in FIG. 11.

In FIG. 11, a hyper NRD guide is used as the dielectric guide of the circulator portion in order to avoid problems caused by mode-changing to LSE01 mode, and because a bend must be provided. Furthermore, the component 102 is provided adjacent to the component 101, and the dielectric strip 32 is provided opposite the dielectric strip of the component 102 so as to connect the components 101 and 102. Therefore, this portion comprises a normal NRD guide. As shown in FIG. 11, guide conversion portions are provided at these two places.

Figure 12:
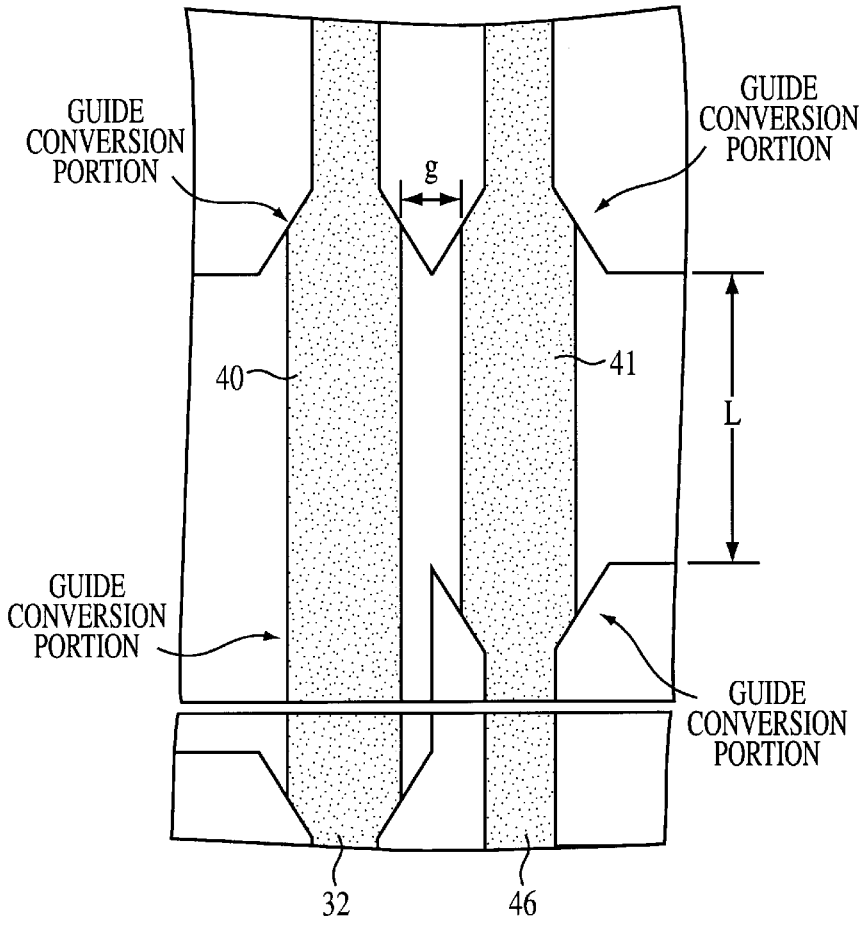
FIG. 12 shows a constitution of a coupler portion.

FIG. 12 is a diagram illustrating the constitution of the coupler portion of FIG. 10, and shows a plan view when the upper conductive plate is removed. As shown in FIG. 12, the space g between the dielectric strips 40 and 41 of normal NRD guides is made narrow along the length L, whereby the two guides become coupled in this portion. Guide conversion portions are provided at the input side and output side of this coupler, changing the guides to hyper NRD guides. For a 3 dB coupler in a 60 GHz band, L=12.8 mm and g=1.0 mm. When g=0.5 mm, L=7.7 mm. As shown in FIGS. 21A and 21B, when the dielectric strips are provided at an equal distance, coupling in the normal NRD guide is stronger than in the hyper NRD guide, coupling strength changing smoothly as the distance changes, and therefore less dimensional precision is required for the interval g between the dielectric strips shown in FIG. 12.

The circulator portion in the component 102 of FIG. 10 has roughly the same constitution as the isolator in the component 101, and comprises a dielectric strip 40 leading from the coupler portion, a dielectric strip 45 leading from the mixer portion, another dielectric strip 44, a ferrite resonator 43 and a magnet, which is not shown in the diagram.

Figure 13:
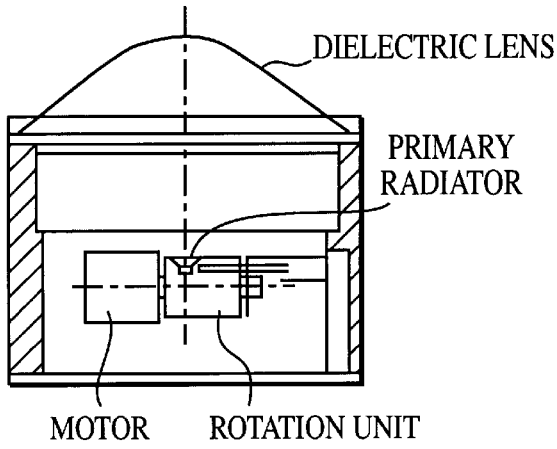
FIG. 13 is a vertical sectional view of an overall structure of a millimeter wave radar module.
Figure 14:
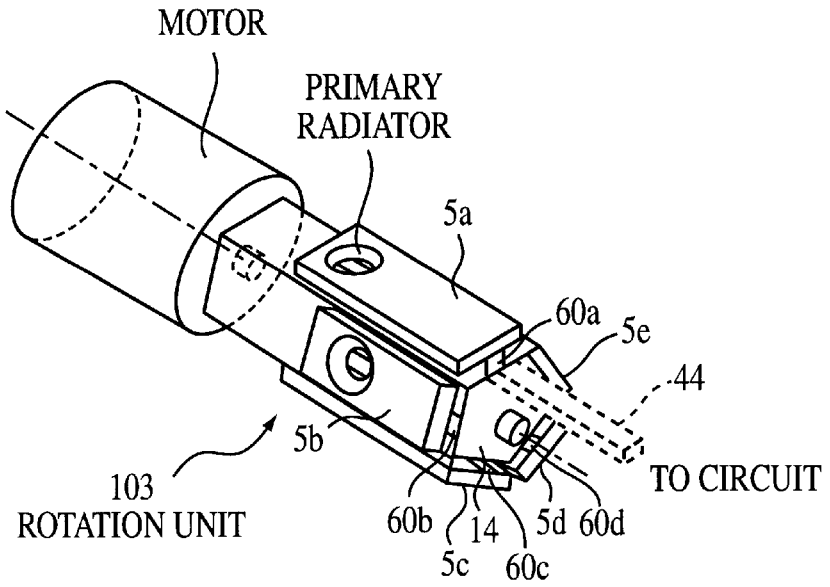
FIG. 14 is a perspective view of a constitution ol a rotation unit.

FIG. 13 is a diagram illustrating the positional relation between the dielectric lens and the rotation unit of FIG. 10, and shomvs a vertical sectional view of the overall structure of the millimeter wave radar module. FIG. 14 is a perspective view of the constitution of the above rotation unit.

In this example, a normal NRD guide comprises dielectric strips which are provided between each side face of a regular pentagonal column-like metal block 14 and conductive plates, which are provided parallel to the side faces. Furthermore, a primary radiator is formed by providing dielectric resonators between all side faces of the metal block 14 and conductive plates provided parallel thereto. These dielectric resonators are provided at different positions parallel to the axis of the rotation unit, and when the rotation unit is rotated by a motor, the position of the primary radiator at the focal point of the dielectric lens is sequentially switched parallel to the rotation axis.

Figure 15A:
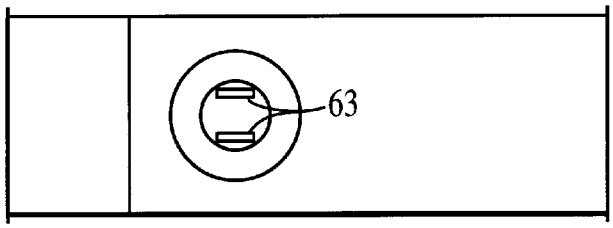
FIGS. 15A and 15B are diagrams showing a constitution of a primary radiator portion.
Figure 15B:
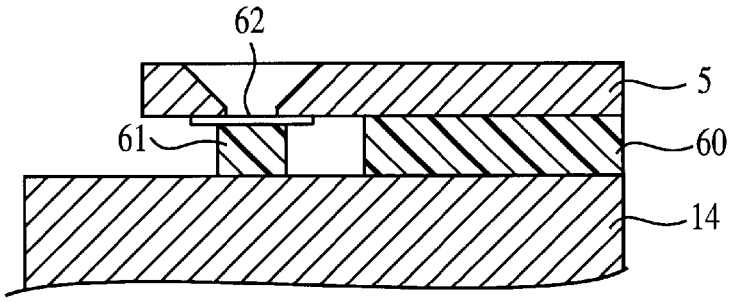

FIGS. 15A and 15B are diagrams showing the constitution of one dielectric guide of the rotation unit and the primary radiator portion, FIG. 15A being a top view, and FIG. 15B, a cross-sectional view. Here, a circular column-shaped HEl11 mode dielectric resonator 61 is provided at a predetermined distance from the end of a dielectric strip 60. A circular cone-shaped window is provided in one portion of a conductive plate 5, so that electromagnetic waves are radiated from and injected into the upper portion (as viewed in the diagram) of the dielectric resonator 61. A slit plate 62 is provided between the dielectric resonator 61 and the conductive plate 5. A slit 63 in this slit plate 62 controls the radiation pattern.

Figure 16:
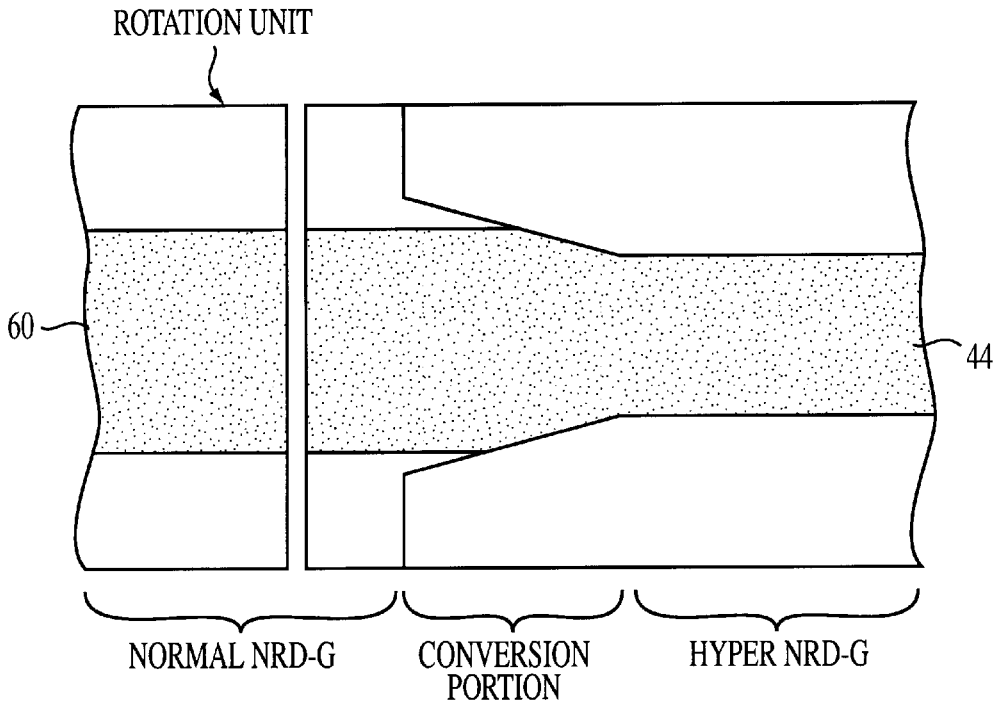
FIG. 16 is a diagram showing a structure of NRD guide connections at a rotation unit side and a circuit side.

FIG. 16 is a diagram showing the structure of connections of the rotation unit side and a circuit side to respective NRD guides. In this way, normal NRD guides are used as the NRD guides on the rotation unit sides and the NRD guides selectively connected to these, and hyper NRD guides and guide conversion portions between the hyper NRD guides and normal NRD guides are provided on the circuit side.

Figure 17:
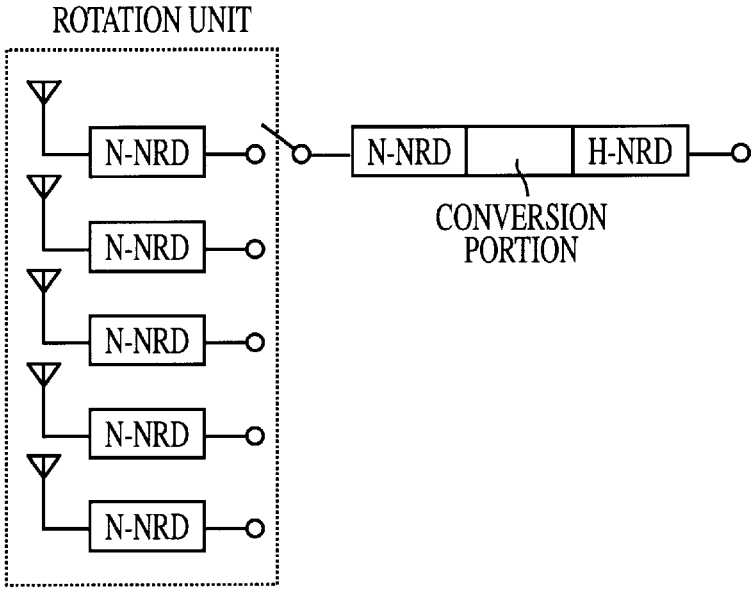
FIG. 17 is an equivalent circuit diagram of a rotation unit portion of a radar module.

FIG. 17 is an equivalent circuit diagram of the rotation unit portion. In this way, by using the portion between the radiation unit 103 and the component 102, shown in FIG. 10, as a dielectric guide switch, providing multiple dielectric guides and a primary radiator to the rotation unit, and rotating the rotation unit, the primary radiator is sequentially switched and its relative position with respect to the dielectric lens changes, thereby sequentially changing the directivity of the beam.

Figure 18:
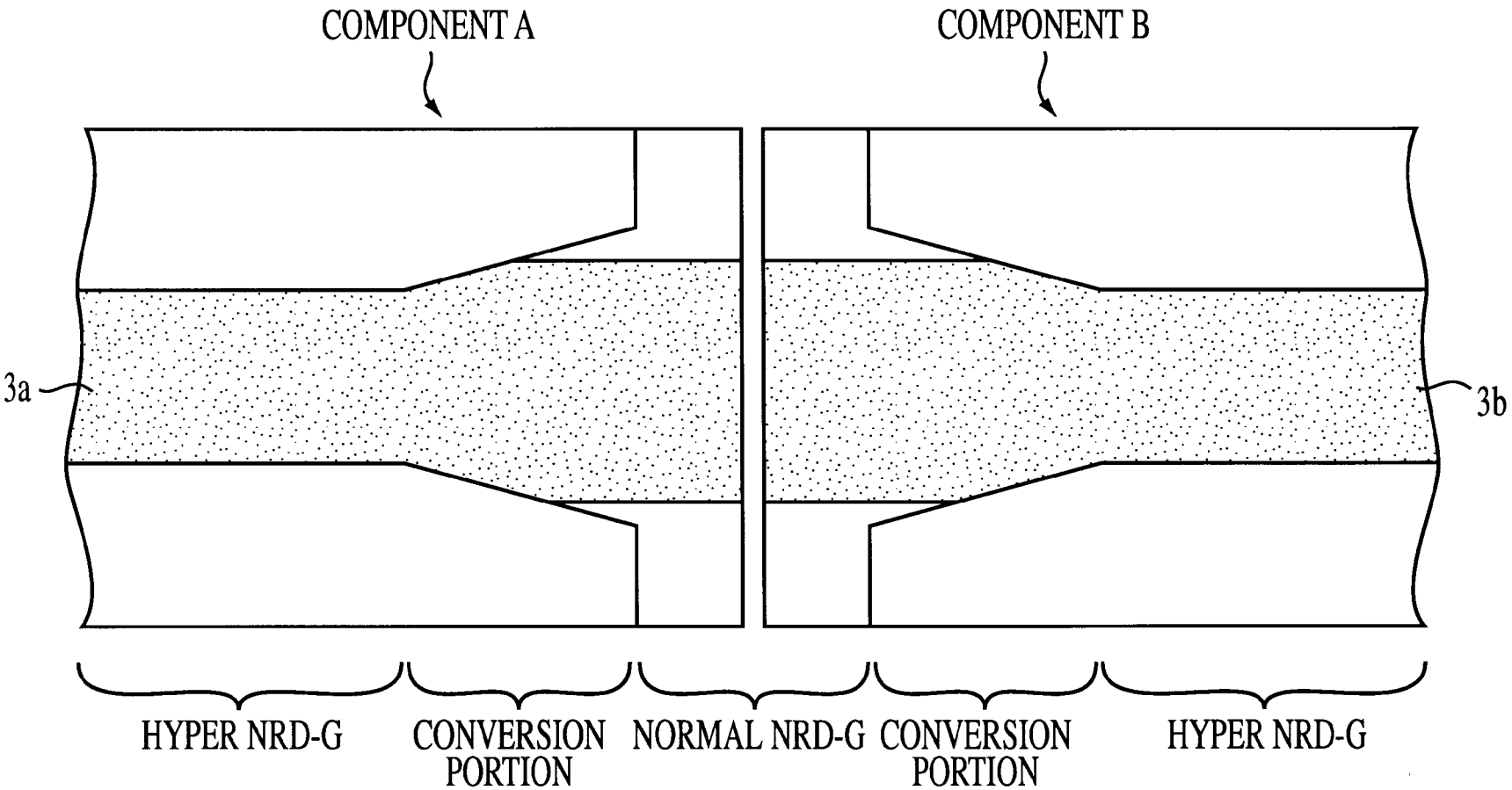
FIG. 18 is a diagram showing a constitution of a connection between components.

In the embodiments described above, a conversion portion was provided to one of two NRD guides to be selectively connected, but, as shown in FIG. 18, when assembling various types of components, conversion portions may be provided at each connection in order to connect the components using normal NRD guides. With this constitution, even if there is slight deviation in the positions of the component A and the component B, changes in characteristics caused by this deviation will be fewer than when two hylper NRD guides are connected together, and therefore a millimeter wave mcdule with little variation in overall characteristics can be provided.

Figure 19A:
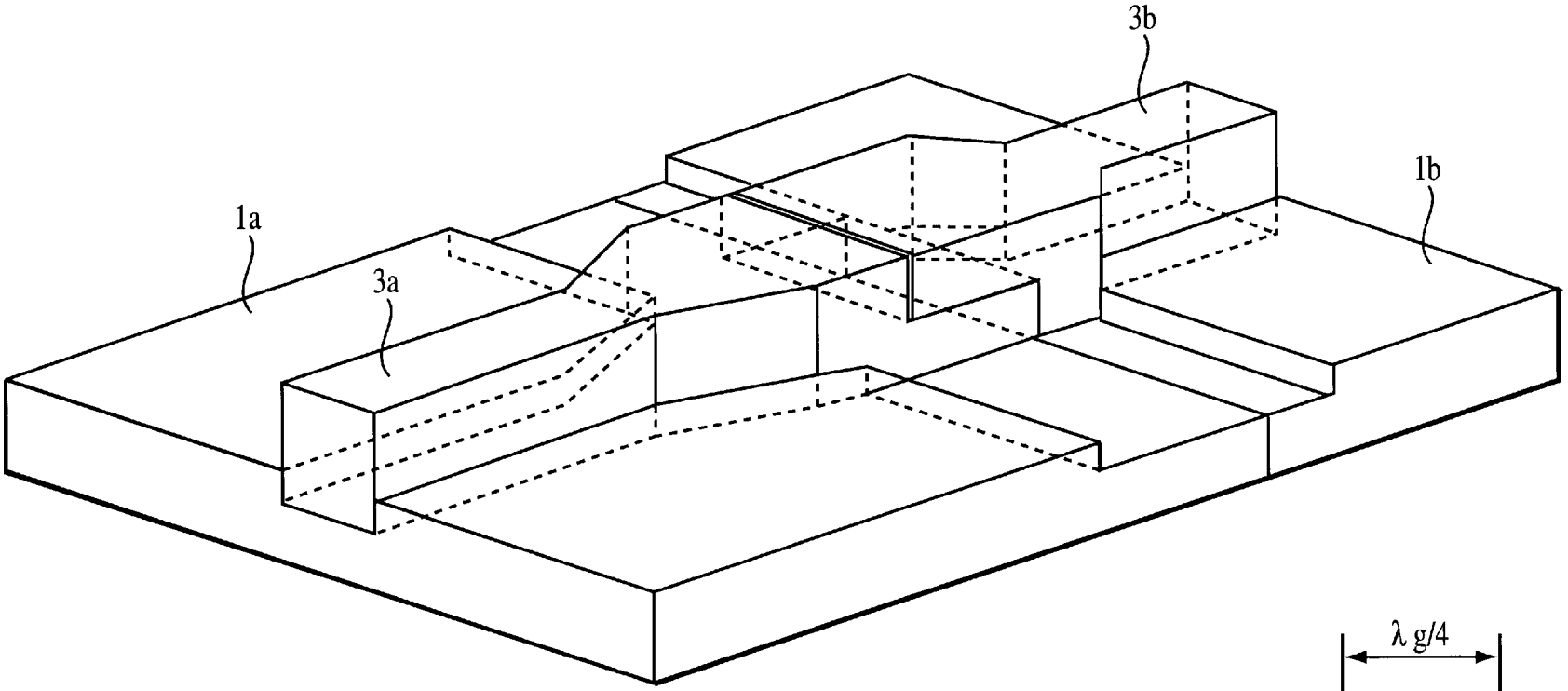
FIGS. 19A and 19B are is a partial perspective view and a cross-sectional view of a constitution of a connection between components.
Figure 19B:
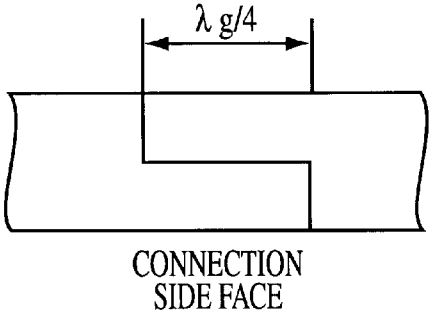
Figure 20:
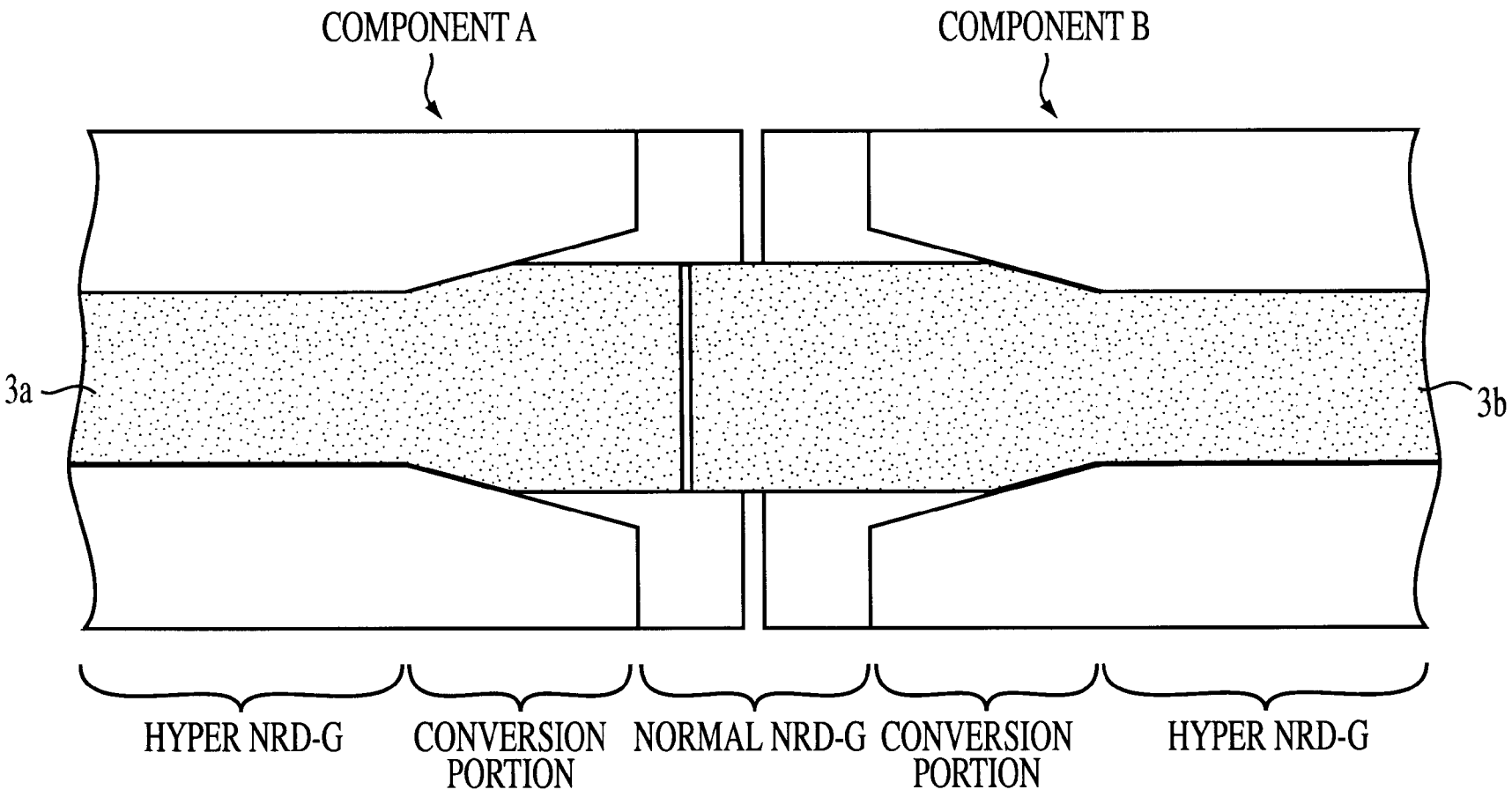
FIG. 20 is a plan view of a constitution of a connection between components.

FIGS. 19A and 19B are respectively a partial perspective view and a cross-sectional view showing a constitution of another connection of NRD guides between two components, and FIG. 20 is a plan view of the same connection. Each shows a state when the upper conductive plate has been removed. The first embodiment described an example in which two dielectric strips opposed each other at a single connection face, but, as shown in FIGS. 19A, 19B and 20, the distance of the connection faces is an odd multiple of a quarter of the guide wavelength at the frequency used. According to this constitution, even when a gap between the connection faces changes as a result of changes in temperature, since waves radiated at the two faces merge in reverse phase, transmission characteristics do not deteriorate, despite temperature changes. Furthermore, since transmission characteristics do not deteriorate even when the dielectric strips 3*a* and 3*b* are slightly shorter, tolerance of the dielectric strip dimensions can be relaxed. Then, since the connection is of normal NRD guides, transmission characteristics do not deteriorate even when there is a slight gap between the upper and lower conductive plates. Consequently, tolerance of the dimensions of the conductive plates can also be relaxed, and less precision is needed when assembling the components.

According to the first aspect of the invention, low radiation guide conversion can be carried out at a connection between a first non radiative dielectric waveguide, comprising a dielectric strip provided between two opposing conductive plates, and a second non radiative dielectric waveguide, comprising two conductive plates having grooves provided therein at opposing positions, and a dielectric strip inserted between the opposing grooves.

According to the second aspect of the invention, radiation at a first conversion portion and a second conversion portion is reduced, thereby improving radiation characteristics of the overall guide conversion portion.

According to the third aspect of the invention, it is possible to obtain excellent propagation characteristics in a switch connected state at a connection between non radiative dielectric waveguides, and in addition, a second non radiative dielectric waveguide (hyper NRD guide) can be used as a guide leading to the switch portion.

According to the fourth aspect of the invention, connection can be performed during relative motion in a rotation unit constituting the above switch portion, with low radiation and low transmission loss, and in addition, a second non radiative dielectric waveguide (hyper NRD guide) can be used.

According to the fifth aspect of the invention, a conversion portion for non radiative dielectric waveguides of different types can te made small-scale without increasing the dimensional precision required of an interval between dielectric strips of the first non radiative dielectric waveguide, and therefore it is possible to obtain a directional coupler which is small-scale overall and has stable characteristics.

According to the sixth aspect of the invention, an oscillator comprises a dielectric resonator which is strongly coupled to a non radiative dielectric waveguide, and moreover, a circuit leading to the oscillator comprises a second non radiative dielectric waveguide, and therefore, the part comprising the oscillator can be made small-scale overall.

According to the seventh aspect of the invention, it is possible to eliminate problems of deterioration and variation of characteristics, caused by position deviation at a connection between integrated circuit parts, and there is no deterioration of characteristics caused by guide conversion, and consequently a non radiative dielectric waveguide integrated circuit with high overall characteristics can easily be obtained.

According to the eighth aspect of the invention, when multiple non radiative dielectric waveguide integrated circuits are combined, radiation at the connections is cancelled, so that the overall combination of integrated circuits can be connected with low radiation.

According to the ninth aspect of the invention, an integrated circuit, which makes good use of characteristics of first and second non radiative dielectric waveguides and suffers no deterioration of characteristics at guide conversion portions, can be obtained.

What is claimed is:

1. A conversion portion structure for first and second non radiative dielectric waveguides for connecting a first non radiative dielectric waveguide, comprising a dielectric strip provided between two opposing conductive plates, to a second non radiative dielectric waveguide, comprising two conductive plates, having grooves provided therein at opposing positions, and a dielectric strip inserted between the opposing grooves, comprising:

a first conversion portion, wherein a width of a dielectric strip therein is changed from a width of said dielectric strip of said second non radiative dielectric waveguide to a width of said dielectric strip of said first non radiative dielectric waveguide;

a second conversion portion, having grooves of substantially the same depth as said grooves in said second non radiative dielectric waveguide, and a dielectric strip of substantially the same width as said dielectric strip of said first non radiative dielectric waveguide; and a third conversion portion, comprising a portion wherein said grooves of said second conversion portion widen in a direction roughly perpendicular to the direction of electromagnetic wave propagation and parallel to faces of said conductive plates, and further comprising said dielectric strip of said first non radiative dielectric waveguide.

2. The conversion portion structure for non radiative dielectric waveguides according to claim 1, wherein, in said first conversion portion, the width of said grooves of said second non radiative dielectric waveguide widens to form a horn-shape, and the width of said dielectric strip in said first conversion portion widens along said grooves; and, in said second conversion portion, said grooves of said second conversion portion follow the widening of said grooves according to said horn-shape and widen from said first conversion portion toward said dielectric strip of said first non radiative dielectric waveguide.

3. A non radiative dielectric waveguide part, comprising:

a switch comprising a connection where, at least two first non radiative dielectric waveguides oppose each other selectively, at least one of said first non radiative dielectric waveguides being connected at an end thereof to a conversion portion structure for first and second non radiative dielectric waveguides;

wherein each said first non radiative dielectric waveguide comprises a dielectric strip provided between two opposing conductive plates, and each said second non radiative dielectric waveguide comprises two conductive plates, having grooves provided therein at opposing positions, and a dielectric strip inserted between the opposing grooves, said conversion portion structure comprising:

a first conversion portion wherein a width of a dielectric strip therein is changed from a width of said dielectric strip of said second non radiative dielectric waveguide to a width of said dielectric strip of said first non radiative dielectric waveguide;

a second conversion portion, having grooves of sulbstantially the same depth as said grooves in said second non radiative dielectric waveguide, and a dielectric strip of substantially the same width as said dielectric strip of said first non radiative dielectric waveguide; and a third conversion portion, comprising a portion wherein said grooves of said second conversion portion widen in a direction roughly perpendicular to the direction of electromagnetic wave propagation and parallel to faces of said conductive plates, and further comprising said dielectric strip of said first non radiative dielectric waveguide.

4. The non radiative dielectric waveguide part according to claim 3, wherein one of said two first non radiative dielectric waveguides, opposing each other selectively at said connection, rotates so as to move relatively in a direction parallel to faces of corresponding conductive plates of a first non radiative dielectric waveguide and perpendicular to the direction of electromagnetic wave propagation.

5. A non radiative dielectric waveguide part, comprising:

a coupler comprising two first non radiative dielectric waveguides provided with a predetermined interval in between, at least one end of each of said first non radiative dielectric waveguides being connected at an end thereof to a conversion portion structure for first and second non radiative dielectric waveguides;

wherein each said first non radiative dielectric waveguide comprises a dielectric strip provided between two oposing conductive plates and each said second non radiative dielectric waveguide comprises two conductive plates having grooves provided therein at opposing positions, and a dielectric strip inserted between the opposing grooves, said conversion portion structure comprising:

a first conversion portion wherein a width of a dielectric strip therein is changed from a width of said dielectric strip of said second non radiative dielectric waveguide to a width of said dielectric strip of said first non radiative dielectric waveguide;

a second conversion portion, having grooves of substantially the same depth as said grooves in said second non radiative dielectric waveguide, and a dielectric strip of substantially the same width as said dielectric strip of said first non radiative dielectric waveguide; and a third conversion portion, comprising a portion wherein said grooves of said second conversion portion widen in a direction roughly perpendicular to the direction of electromagnetic wave propagation and parallel to faces of said conductive plates, and further comprising said dielectric strip of said first non radiative dielectric waveguide.

6. A non radiative dielectric waveguide part, comprising:

a dielectric resonator and an oscillator coupled to a first non radiative dielectric waveguide, said first non radiative dielectric waveguide being connected at an end thereof to a conversion portion structure for first and second non radiative dielectric waveguides;

wherein each said first non radiative dielectric weveguide comprises a dielectric strip provided between two opposing conductive plates, and each said second non radiative dielectric waveguide comprises two conductive plates, having grooves provided therein at opposing positions, and a dielectric strip inserted between the opposing grooves, said conversion portion structure comprising:

a first conversion portion, wherein a width of a dielectric strip therein is changed from a width of said dielectric strip of said second non radiative dielectric waveguide to a width of said dielectric strip of said first non radiative dielectric waveguide;

a second conversion portion, having grooves of substantiall the same depth as said grooves in said second non radiative dielectric waveguide, and a dielectric strip of substantially the same width as said dielectric strip of said first non radiative dielectric waveguide; and a third conversion portion, comprising a portion wherein said grooves of said second conversion portion widen in a direction roughly perpendicular to the direction of electromagnetic wave propagation and parallel to faces of said conductive plates, and further comprising said dielectric strip of said first non radiative dielectric waveguide.

7. An integrated circuit part comprising first and second non radiative dielectric waveguides, comprising: a first non radiative dielectric waveguide, provided at a connection with another integrated circuit part which is adjacent thereto, said first non radiative dielectric waveguide being connected to a conversion portion structure for first and second non radiative dielectric waveguides;

wherein each said first non radiative dielectric waveguide comprises a dielectric strip provided between two opposing conductive plates, and each said second non radiative dielectric waveguide comprises two conductive plates, having grooves provided therein at opposing positions, and a dielectric strip inserted between the opposing gooves, said conversion portion structure comprising:

a first conversion portion, wherein a width of a dielectric strip therein is changed from a width of said dielectric strip of said second non radiative dielectric waveguide to a width of said dielectric strip of said first non radiative dielectric waveguide;

a second conversion portion, having grooves of substantially the same depth as said grooves in said second non radiative dielectric waveguide, and a dielectric strip of substantially the same width as said dielectric strip of said first non radiative dielectric waveguide; and a third conversion portion, comprising a portion wherein said grooves of said second conversion portion widen in a direction roughly perpendicular to the direction of electromagnetic wave propagation and parallel to faces of said conductive plates, and further comprising said dielectric strip of said first non radiative dielectric waveguide.

8. The non radiative dielectric waveguide integrated circuit part according to claim 7, wherein said dielectric strip of said first non radiative dielectric waveguide at said connection is connected to a dielectric strip of said other integrated circuit part at a plurality of faces, said faces being separated from each other by a distance of an odd multiple of a quarter of the guide wavelength in the direction of electromagnetic wave propagation.

9. A non radiative dielectric integrated circuit comprising a pair of non radiative dielectric waveguide parts, comprising:

a switch comprising a connection where at least two first non radiative dielectric waveguides, which are disposed on different respective ones of said pair of non radiative dielectric waveguide parts, oppose each other selectively, at least one of said first non radiative dielectric waveguides being connected at an end thereof to a conversion portion structure for first and second non radiative dielectric waveguides;

wherein each said first non radiative dielectric waveguide comprises a dielectric strip provided between two opposing conductive plates, and each said second non radiative dielectric waveguide comprises two conductive plates, having grooves provided therein at opposing positions, and a dielectric strip inserted between the opposing grooves, said conversion portion structure comprising:

a first conversion portion, wherein a width of a dielectric strip therein is changed from a width of said dielectric strip of said second non radiative dielectric waveguide to a width of said dielectric strip of said first non radiative dielectric waveguide;

a second conversion portion, having grooves of substantially the same depth as said grooves in said second non radiative dielectric waveguide, and a dielectric strip of substantially the same width as said dielectric strip of said first non radiative dielectric wave guide; and a third conversion portion, comprising a portion wherein said grooves of said second conversion portion widen in a direction roughly perpendicular to the direction of electromagnetic wave propagation and parallel to faces of said condctive plates, and further comprising said dielectric strip of said first non radiative dielectric waveguide.

* * * * *